United States Patent [19]

Moriyama

[11] Patent Number: 4,832,518

[45] Date of Patent: May 23, 1989

[54] APPARATUS FOR DRIVING AND CONTROLLING A PRINTING HEAD CARRIAGE

[75] Inventor: Jiro Moriyama, Yokohama, Japan

[73] Assignee: Canon Kabushiki Kaisha, Tokyo, Japan

[21] Appl. No.: 906,029

[22] Filed: Sep. 11, 1986

[30] Foreign Application Priority Data

Sep. 18, 1985 [JP] Japan ..... 60-204349

[51] Int. Cl.[4] ..... B41J 19/30

[52] U.S. Cl. ..... 400/322; 400/279; 400/328

[58] Field of Search ..... 400/279, 320, 322, 323, 400/328, 903

[56] References Cited

U.S. PATENT DOCUMENTS

| | | | |
|---|---|---|---|
| 4,146,922 | 3/1979 | Brown | 400/322 X |
| 4,147,967 | 4/1979 | Aiena | 400/322 X |
| 4,285,606 | 8/1981 | Giacone | 400/322 X |
| 4,404,572 | 9/1983 | Okamura et al. | 346/140 R |
| 4,415,911 | 11/1983 | Tazaki | 400/322 X |

*Primary Examiner*—Paul T. Sewell

*Attorney, Agent, or Firm*—Fitzpatrick, Cella, Harper & Scinto

[57] ABSTRACT

A printing apparatus is provided with a drive device for driving a carriage supporting a printing head, a speed control device for releasing a control signal for controlling the speed of the drive device, and a signal output device for releasing a control signal, in the place of the speed control device.

4 Claims, 5 Drawing Sheets

APPARATUS FOR DRIVING AND CONTROLLING A PRINTING HEAD CARRIAGE

BACKGROUND OF THE INVENTION

1. Field of the Invention

The present invention relates to a recording apparatus in which a carriage is controlled by means of a linear encoder.

2. Related Background Art

In general, a printer checks the presence of a printing sheet by a sheet sensor in response to a print instruction, and, in the presence of the printing sheet, feeds the printing sheet to a printing position by driving a platen with a line-feed motor. Subsequently, a printing operation is effected by reciprocating a printing head with a carriage motor in a lateral direction, and, prior to the printing operation, a home position sensor detects that the printing head is at a home position.

FIG. 1 shows such a home position sensor 4 and its relation with a linear-encoder 5 having slits as shown in FIG. 2.

Light emitted by light-emitting diodes 30 is transmitted to phototransistors 32 through the linear encoder 5 and a light-receiving slit 31 to generate a signal corresponding to the slits 5-1 of the linear encoder. The signal is supplied as a feedback signal to a carriage motor 8, and is also utilized as a print timing signal for a printing head 2. Another signal corresponding to slits 5-2 of the linear encoder 5 is used for defining the printing range in the displacement of the carriage.

In contrast to the linear encoder 5 of FIG. 2, requiring two sets of light-emitting diodes and phototransistors, there has also been proposed, in the Japanese Patent Application Laid-open No. 65308/1985, a control method utilizing only one series of slits as shown in FIG. 3. In such method, the linear encoder 5 has slits up to broken-lined positions whereby the movement of a carriage 8 takes place as indicated by chain lines. In this method, the carriage is reversed always after it returns to the home position. Consequently, the moving range of the carriage is considerably larger than the printing range b, and there is required a long time for reversing the carriage.

In order to avoid the above-mentioned drawbacks, it is known to reduce the number of slits to solid slits shown in FIG. 3, by eliminating the slits in the broken-lined area, thus shortening the reversing ranges for the carriage 8. In FIG. 3 b indicates the printing range, while a and c indicate reversing ranges for the carriage 8. This method allows shortening of the reversing time of the carriage, but, in a first line in which the carriage 8 starts from the home position 50, the carriage exceeds a predetermined speed vl as indicated by a curve 51, so that the carriage speed reaches a value above a servo control range when the carriage enters the printing range.

Such excessively high speed gives rise to a shorter interval of ink emission, in the case of an ink jet printer, which ink jet recording head may not be able to respond to, or gives rise to other failures of the apparatus.

SUMMARY OF THE INVENTION

An object of the present invention is to avoid the aforementioned drawback and to provide a recording apparatus in which a pseudo speed signal is released when the printing head is positioned outside a speed control range, thereby preventing the printing head to reach a speed exceeding a predetermined value.

Other objects of the present invention will become fully apparent from the following description of the embodiments of the present invention.

DESCRIPTION OF THE PREFERRED EMBODIMENTS

Now the present invention will be clarified in detail by an embodiment thereof shown in the attached drawings.

Figure 1:
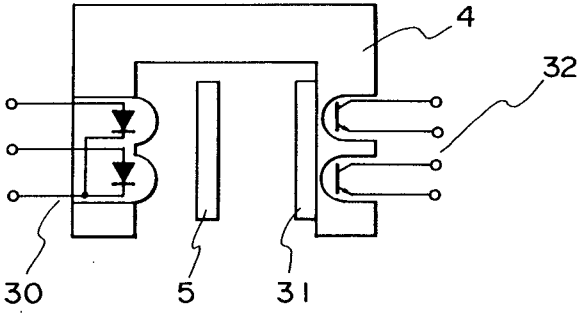
FIG. 1 is a schematic view showing a conventional arrangement of photosensors and a linear scale.
Figure 2:
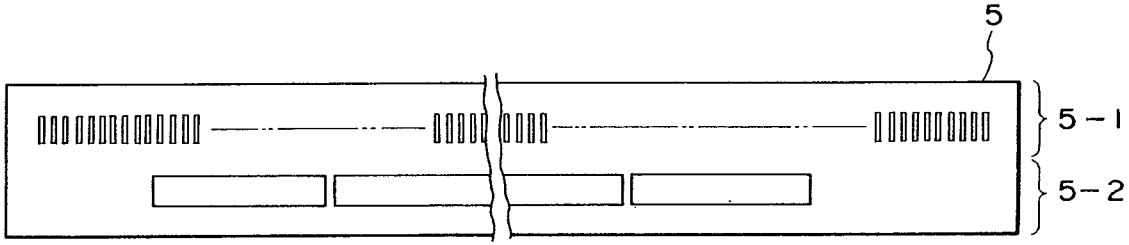
FIG. 2 is an external view of the linear encoder shown in FIG. 1.
Figure 3:
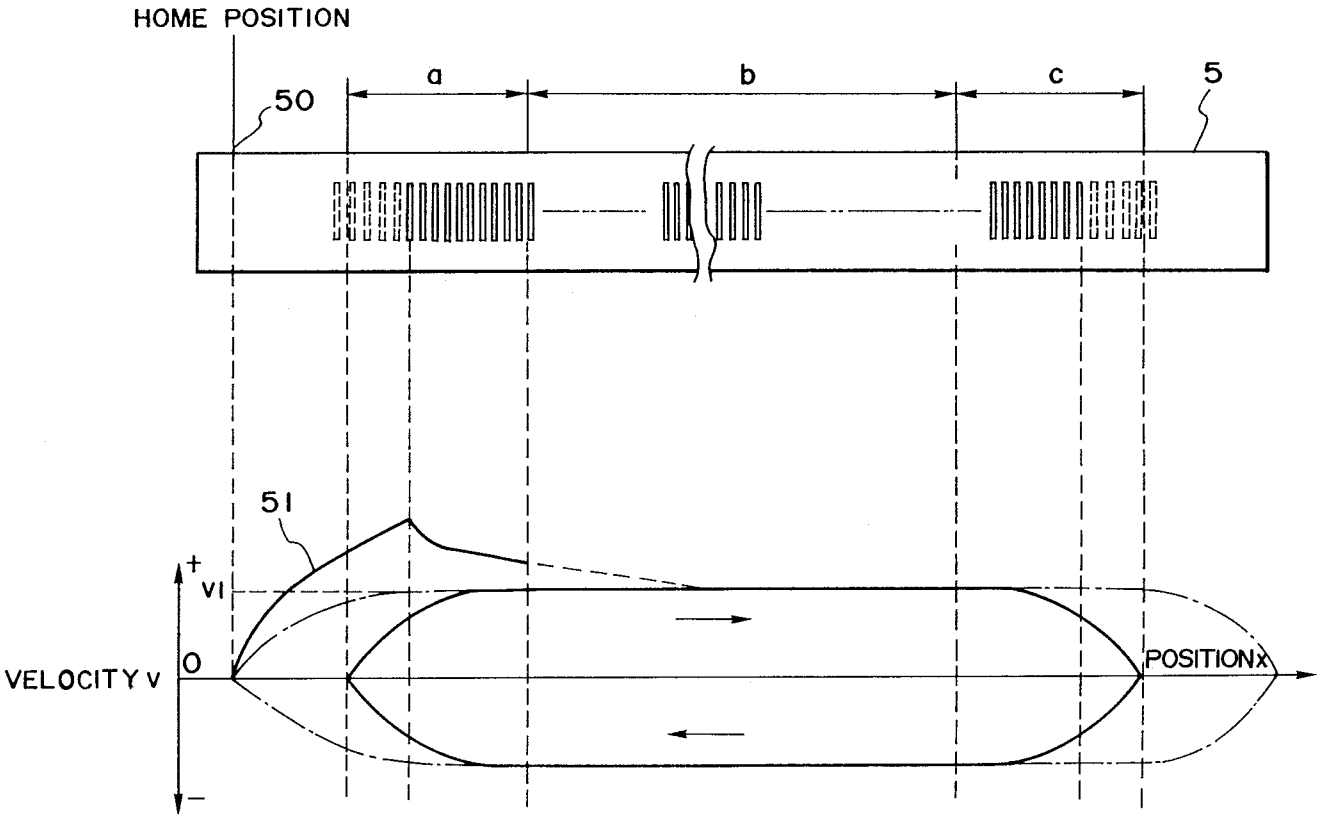
FIG. 3 is a view of the linear encoder and a corresponding chart showing the speed of a carriage motor.
Figure 4:
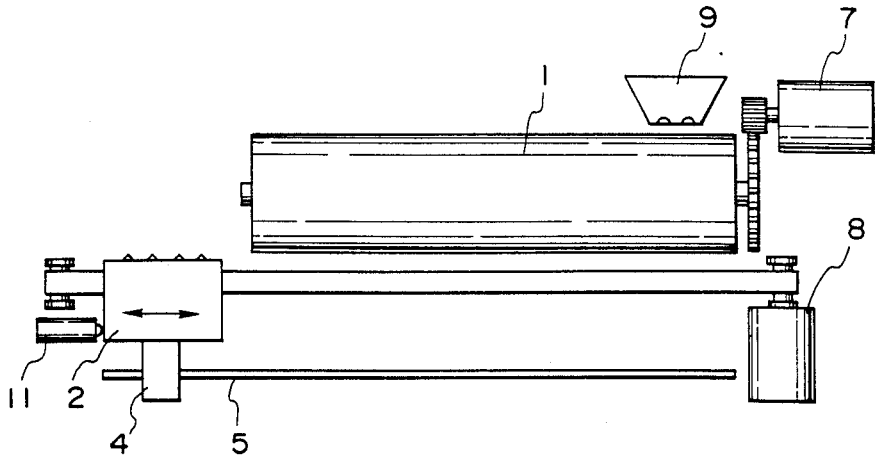
FIG. 4 is a schematic view of a recording apparatus embodying the present invention.

FIG. 4 illustrates a recording apparatus wherein provided are a platen 1, a printing head 2, a photosensor 4, a linear encoder 5, a line feed motor 7 for driving the platen, a carriage motor 8, a sheet sensor 9, and a home position sensor 11 for detecting that the printing head is in a home position.

Figure 5:
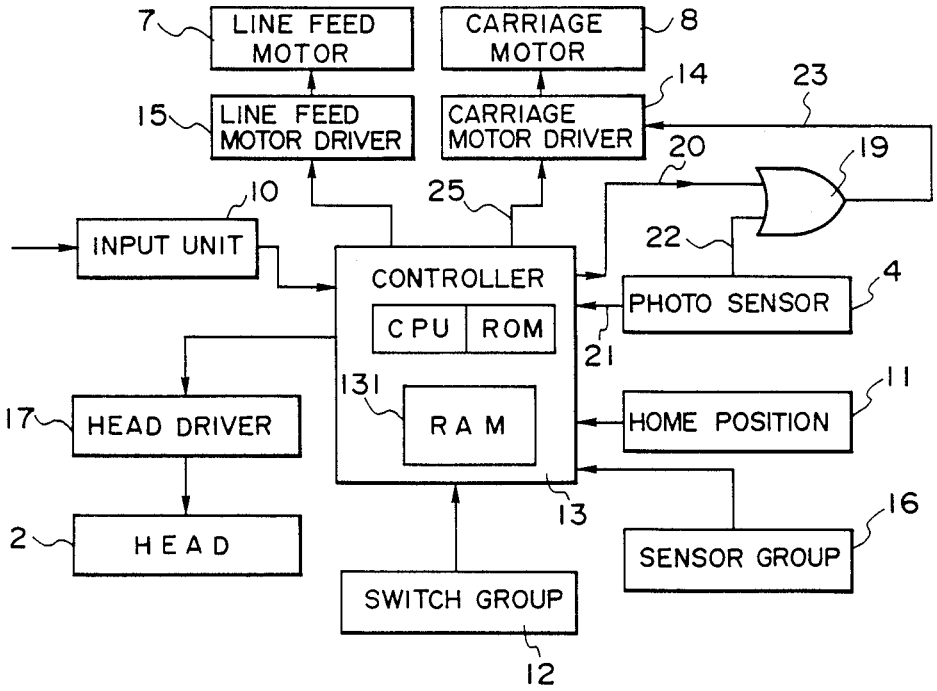
FIG. 5 is an electrical block diagram of the apparatus shown in FIG. 1.

FIG. 5 is a corresponding block diagram wherein shown are an input unit 10 for entering print data such as image data; a control unit 13 for controlling the entire apparatus, including a central processing unit (CPU) such as a microprocessor, a read-only memory (ROM) for storing control programs and data for the CPU, and a random access memory (RAM) 131 for temporary data storage; a group 12 of plural switches for giving instructions such as printing or sheet feeding; a carriage motor driving circuit 14, consisting of a DC servo control circuit for driving the carriage motor 8; a line feed motor driving circuit 15 for driving the line feed motor 7; a sensor group 16 including the sheet sensor; a head driver 17 for releasing image data for driving the printing head 2; a false feedback signal 20 released by the control unit 13; and a feedback signal 22 supplied from the photosensor 4 to the carriage motor driving circuit 14.

Figure 6:
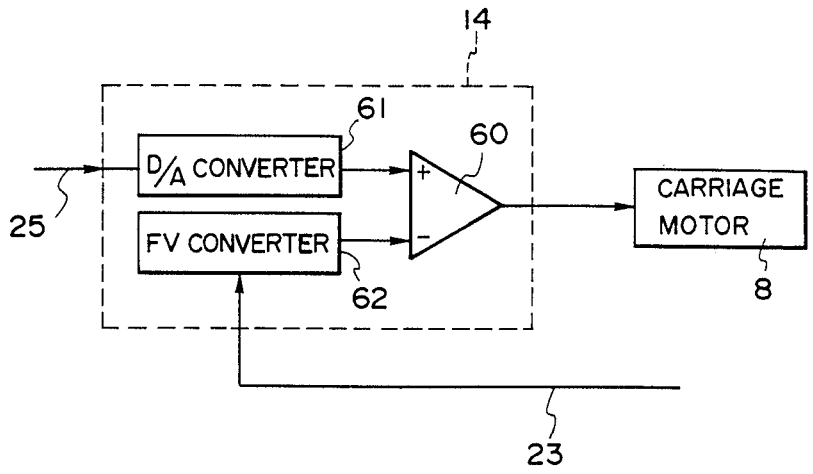
FIG. 6 is a block diagram of a driving circuit for the carriage motor shown in FIG. 5.

FIG. 6 is a block diagram of the carriage motor driving circuit 14, wherein the feedback signal 23 from the photosensor 4 is supplied to an F/V converter to generate a voltage in response to the frequency of the feedback signal 23. A D/A converter 61 converts a motor driving signal 25 from the control unit 13 into an analog voltage. An operational amplifier 60 processes the outputs of the D/A converter 61 and the F/V converter 62 to generate a driving voltage for the carriage motor 8.

When the revolution of the carriage motor 8 increases to elevate the frequency of the feedback signal 23, the F/V converter 62 increases its output voltage, whereby the operational amplifier 60 decreases the output voltage to the carriage motor 8, thus reducing the revolution thereof. On the other hand, if the revolution of the carriage motor does not increase or if the carriage is positioned in an area where the feedback signal 23 is not generated, the frequency of the feedback signal 23 does not increase, so that the output voltage of the F/V converter 62 is not elevated. Consequently, the driving voltage for the carriage motor 8 remains high, thus maintaining the carriage motor at a high speed.

Figure 7:
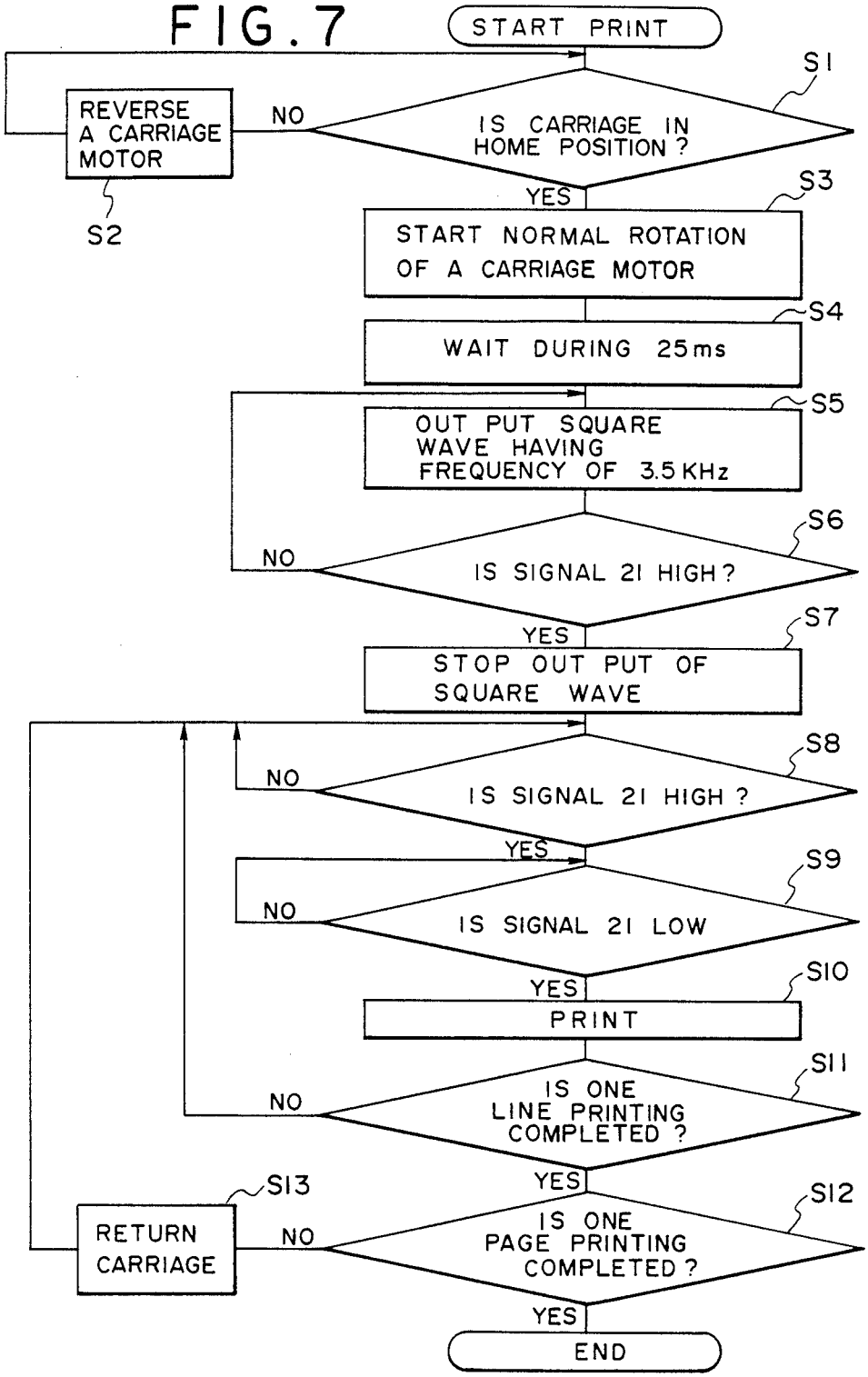
FIG. 7 is a flow chart of a printing operation of the circuit shown in FIG. 5.

Now reference is made to a flow chart shown in FIG. 7, for explaining the function of the above-explained circuit and apparatus.

The flow chart shown in FIG. 7, for the printing operation of the CPU, is stored in the ROM of the control unit 13.

At first a step S1 discriminates, by the home position sensor 11, whether the printing head 2 is in the home position. If not, the program proceeds to a step S2 for reversing the carriage motor 8, thereby moving the printing head 2 to the home position. When the printing head 2 is moved to the home position, the program proceeds to a step S3 for rotating the carriage motor 8 in the forward direction, thereby initiating the movement of the printing head 2.

A step S4 carries out a waiting time for 25 ms in consideration of the start-up time of the carriage motor 8. A step S5 generates a square wave of 3.5 kHz as the pseudo feedback signal 20, which is supplied, through an OR gate 19, to the carriage motor driving circuit 14. This frequency is selected to be slightly higher than the frequency 3 kHz of the feedback signal 22 from the photosensor 4 when the carriage is running at a constant speed.

A step S6 discriminates whether the timing signal 21 from the photosensor 4 is shifted to the high level. If not, the program returns to the step S5 to continue generation of the false feedback square wave. However, if the step S6 discriminates the shift of the signal 21 to the high level, the program proceeds to a step S7 to terminate the generation of the false feedback signal square wave 20.

According to the present invention, while the carriage is moving in an area not detectable by the photosensor 4, the psuedo feedback signal 20 is generated by the control unit 13 and supplied to the carriage motor driving circuit 14.

A step S8 discriminates whether the timing signal 21 from the photosensor 4 is shifted to the high level, and, when it is shifted to the high level, the program proceeds to a step S9 for discriminating whether the timing signal 21 is shifted to the low level. These steps detect the slit position of the linear-encoder 5, and the print timing is defined at the shift-down of the timing signal 21, or when the light from the light-emitting diode passes through the slit.

When the print timing is reached, a step S10 effects a printing operation, and a step S11 discriminates whether the printing operation of a line has been completed. If not completed, the program returns to the step S8 to repeat the above-explained procedure.

Upon completion of the printing operation of a line, the program proceeds to a step S12 to discriminate whether the printing operation of a page has been completed. If not completed, the program proceeds to a step S13 for a carriage return operation, then returns to the step S8 for repeating the above-explained procedure until the printing operation of a page is completed.

Figure 8:
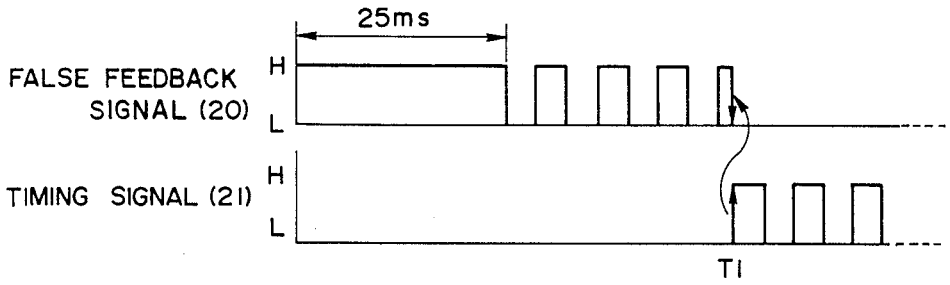
FIG. 8 is a timing chart showing a pseudo feedback signal and a timing signal.

FIG. 8 is a timing chart showing the timing of the pseudo feedback signal 20 and the feedback signal 22 from the photosensor 4.

In this chart a dummy signal 20 is shown to assume the high level for a duration of 25 ms, but it may also be of the low level. Regardless of the level, it is required that a dummy signal continue for an initial duration of 25 ms. After the lapse of 25 ms, a square wave of a frequency of 3.5 kHz is released, and, when the feedback signal 21 from the photosensor 4 is shifted to the high level at a timing T1, the pseudo feedback signal 20 is terminated.

The frequency of the pseudo feedback signal 20 is selected as 3.5 kHz which is slightly higher than the reference frequency, 3 kHz, of the DC servo operation, in order to prevent the carriage from reaching a speed higher than a predetermined value, for example, due to a fluctuation in the mechanical friction of the carriage and also in order to prevent that the carriage from becoming excessively slower than the predetermined value.

In the present embodiment the pseudo feedback signal is generated by software, but it may also be generated by hardware in case the load to the CPU is too high.

In the present embodiment, it is assumed that the number of slits of the linear encoder is equal to the number of print dots, but it is also possible to applying an inverse voltage to the carriage motor immediately after the completion of printing operation of a line, thereby reversing the carriage within the shortest time. In such case the speed of the carriage in printing the first dot of a succeeding line does not reach the predetermined value but remains, for example, ca. 90% thereof. This fact is not a problem in the present embodiment, but, if it is not tolerated due to the characteristic of the printing head, it is possible to extend the slits beyond the printing range or to reverse the carriage motor not immediately after the completion of printing operation of a line but after the lapse of a predetermined time, thereby attaining the predetermined speed at the printing of the first dot of the succeeding line.

In the foregoing explanation, the carriage motor is composed of a DC servo motor, but it may be composed of other motors, such as a linear motor.

As explained in the foregoing, the present invention provides an advantage of preventing a printing operation with a frequency higher than the frequency characteristic of the printing head, by generating a dummy speed control signal when the carriage is positioned outside a speed control range, thereby preventing excessively high speed of the carriage beyond the predetermined value.

What is claimed is:

1. An apparatus for driving a printing head carriage having a printing range and a home position outside the printing range, the apparatus comprising:

driving means for driving said carriage in a driving region that includes the printing range and the home position;

detecting means for indicating the position of said carriage in the driving region and for detecting the velocity of said carriage in a detecting area of the driving region that excludes the home position and generating a feedback signal representing the velocity of said carriage;

a controller for generating a dummy signal to replace the feedback signal when said detecting means detects that said carriage is outside the detecting area and for generating a driving signal; and driving control means for controlling said driving means, wherein said driving control means includes a calculation means for operating on the driving signal using either the feedback signal or the dummy signal to generate an output signal provided to said driving means to control the velocity of said carriage and said calculating means generates the output signal such that said driving means drives said carriage no faster than a predetermined velocity when said detecting means detects that said carriage is outside the detecting area.

2. An apparatus according to claim 1, wherein the dummy signal has a frequency higher than that of the feedback signal.

3. An apparatus according to claim 2, wherein the driving signal is digital and said calculating means comprises a frequency-to-voltage converter for generating a voltage in response to the frequency of the feedback signal or the dummy signal, a digital-to-analog converter for converting the digital driving signal to an analog signal, and an operational amplifier for calculating the outputs of said frequency-to-voltage and digital-to-analog converters, whereby the driving control means controls said driving means in response to the output of said operational amplifier.

4. An apparatus according to claim 1, wherein said detecting means comprises a linear encoder including a portion having slits in the detecting area, and a sensor for detecting said slits.

* * * * *

UNITED STATES PATENT AND TRADEMARK OFFICE

CERTIFICATE OF CORRECTION

PATENT NO. : 4,832,518

DATED : May 23, 1989

INVENTOR(S) : Moriyama

It is certified that error appears in the above-identified patent and that said Letters Patent is hereby corrected as shown below:

COLUMN 2:

Line 27, change "clarified" to --explained--.

COLUMN 4:

Line 15, change "carriage" to --carriage,--; and

Line 25, change "applying" to --apply--.

Signed and Sealed this

Twenty-third Day of October, 1990

*Attest:*

HARRY F. MANBECK, JR.

*Attesting Officer*

*Commissioner of Patents and Trademarks*